US008944640B2

(12) United States Patent
Dalsgaard et al.

(10) Patent No.: US 8,944,640 B2
(45) Date of Patent: Feb. 3, 2015

(54) LAMP REFLECTOR SYSTEM WITH RETRO REFLECTOR

(71) Applicants: Carsten Dalsgaard, Silkeborg (DK); Lars Barslund Kjær, Hovedgård (DK); Aleksander Henrik Von Preyss, Lystrup (DK); Niels Jørgen Rasmussen, Egå (DK); Uffe Kjærsgaard Toft, Højbjerg (DK)

(72) Inventors: Carsten Dalsgaard, Silkeborg (DK); Lars Barslund Kjær, Hovedgård (DK); Aleksander Henrik Von Preyss, Lystrup (DK); Niels Jørgen Rasmussen, Egå (DK); Uffe Kjærsgaard Toft, Højbjerg (DK)

(73) Assignee: Martin Professional ApS, Aarhus N. (DK)

( * ) Notice: Subject to any disclaimer, the term of this patent is extended or adjusted under 35 U.S.C. 154(b) by 99 days.

(21) Appl. No.: 13/760,504

(22) Filed: Feb. 6, 2013

(65) Prior Publication Data

US 2013/0201689 A1 Aug. 8, 2013

(30) Foreign Application Priority Data

Feb. 6, 2012 (DK) ..... 2012 70060
May 1, 2012 (DK) ..... 2012 70221

(51) Int. Cl.

| | |
|---|---|
| ***F21V 29/02*** | (2006.01) |
| ***F21V 29/00*** | (2006.01) |
| ***F21V 7/00*** | (2006.01) |
| ***F21V 7/20*** | (2006.01) |
| *F21W 131/406* | (2006.01) |

(52) U.S. Cl.

CPC ..... *F21V 29/02* (2013.01); *F21V 29/2212* (2013.01); *F21V 7/0025* (2013.01); *F21V 7/20* (2013.01); *F21V 29/027* (2013.01); *F21W 2131/406* (2013.01)

USPC ..... 362/294

(58) Field of Classification Search

CPC ..... F21V 29/02; F21V 29/004; F21V 29/025; F21V 29/027; F21V 7/0025; F21V 7/0033; F21V 17/00

See application file for complete search history.

(56) References Cited

U.S. PATENT DOCUMENTS

| | | | | |
|---|---|---|---|---|
| 1,256,522 | A | 2/1918 | Croxton | |
| 2002/0136028 | A1 * | 9/2002 | Smith | 362/580 |
| 2002/0159262 | A1 * | 10/2002 | Romano et al. | 362/345 |
| 2003/0098652 | A1 * | 5/2003 | Beech et al. | 313/634 |
| 2008/0137344 | A1 | 6/2008 | Lang et al. | |
| 2008/0218050 | A1 | 9/2008 | Soma et al. | |

(Continued)

FOREIGN PATENT DOCUMENTS

| | | |
|---|---|---|
| EP | 1471563 | 10/2004 |
| JP | 2002-25305 | 1/2002 |

OTHER PUBLICATIONS

Extended European Search Report; Dated: May 27, 2013; European Application No. 13154160.9; 10 pages.

English abstract; Japanese Application No. 2002025305; Dated: Jan. 25, 2002; 1 page.

(Continued)

*Primary Examiner* — Bao Q Truong

(74) *Attorney, Agent, or Firm* — Blank Rome LLP

(57) ABSTRACT

The present invention relates to main reflector and cooling system where a light source has been arranged in a main reflector and where cooling air is provided to the light source. The reflector and cooling system comprises a retro reflector arrange outside and facing the main reflector and the retro reflector comprises air inlets for providing cooling air towards the light source and air outlets for dissipating heated cooling air from the light source. The present invention relates also to a retro reflector for a reflector and cooling system.

26 Claims, 11 Drawing Sheets

(56) References Cited

U.S. PATENT DOCUMENTS

| | | | | |
|---|---|---|---|---|
| 2009/0303724 | A1* | 12/2009 | Bjerre | 362/294 |
| 2011/0007410 | A1 | 1/2011 | Honma et al. | |
| 2011/0234993 | A1 | 9/2011 | Wada | |

OTHER PUBLICATIONS

Danish Office Action; Application No. PA201270221; Dated: Dec. 11, 2012; 3 pages.

Danish Search Report; Application No. PA201270221; Dated Dec. 11, 2012; 3 pages.

* cited by examiner

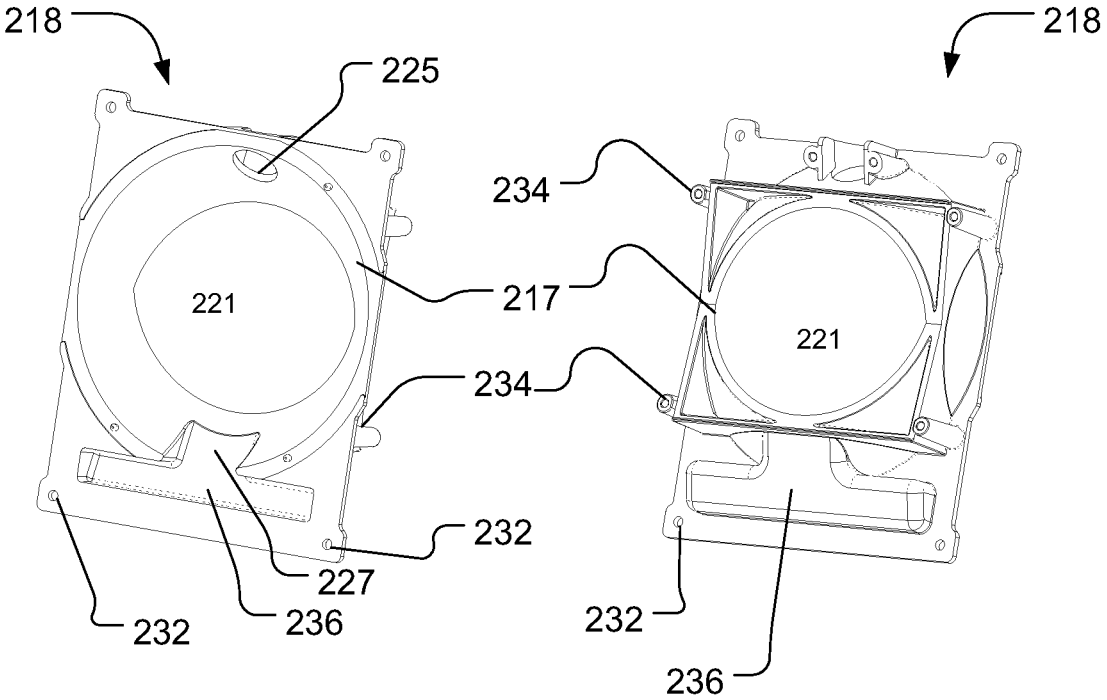
Fig. 3a
Fig. 3b
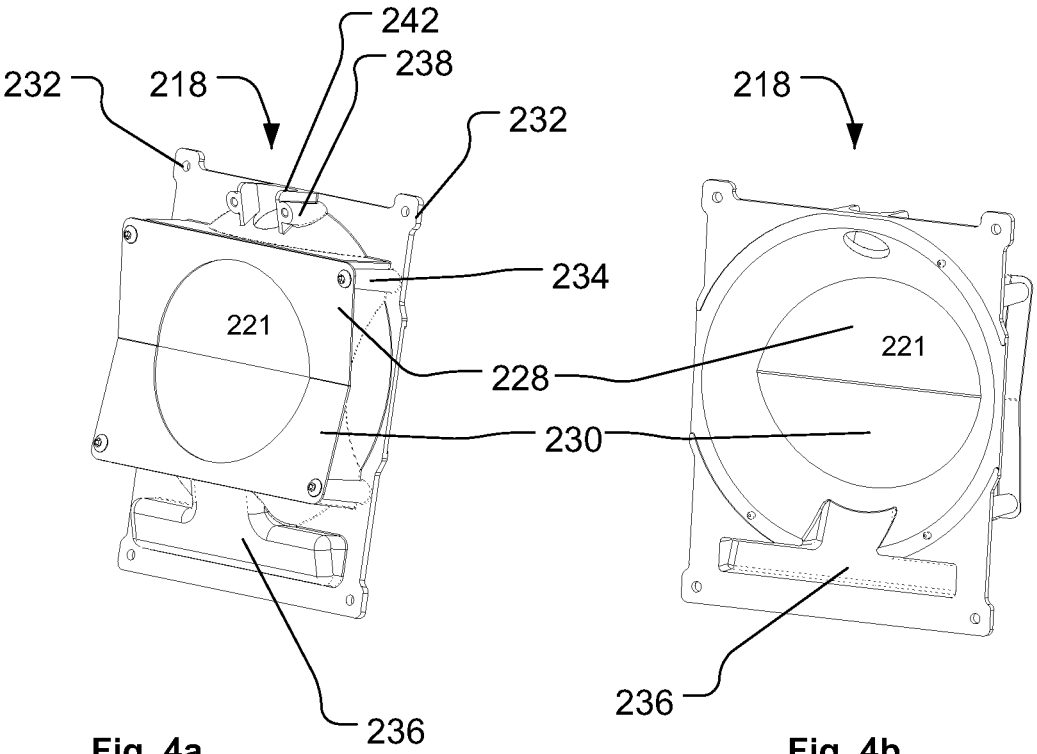
Fig. 4a
Fig. 4b

LAMP REFLECTOR SYSTEM WITH RETRO REFLECTOR

RELATED APPLICATIONS

This application is claiming priority to Danish Application No.: PA201270221 filed May 1, 2012 and Danish Application No.: PA201270060 filed Feb. 6, 2012, which applications are incorporated herein by reference

FIELD OF THE INVENTION

The present invention relates to a reflector and cooling system where a light source is arranged in a main reflector and where cooling air is provided to the light source.

BACKGROUND OF THE INVENTION

Illumination systems where a lamp such as discharge lamps or incandescent lamps have been arranged in reflector adapted the reflect a part of the emitted light in a predefined direction along an optical axis have been known for many years. Further it is known that such lamps need to be cooled in order to provide stable emission spectra of the emitted light and improve the lifetime of the lamp.

Such illumination systems can be used in projecting systems where the light need to be coupled through an optical gate where a light modifying element such as gobos, LCD, DMD or DLPs can be positioned and where an optical system is adapted to image the optical gate at a target surface along the optical axis. Projecting systems are also widely used in the entertainment industry where the illumination devices are used to create exiting light effects and for instance can be mounted in a moving head light fixture. In a moving head light fixture the projecting system is arranged in a housing rotatable connected to a yoke, which is rotatable connected to a base. The head can hereby be panned and tilted in relation the base and the light beam created by the projecting system can thus be moved around.

In projecting systems it is known to arrange a retro reflector along the optical axis and which is adapted to reflect a part of the emitted light back to the reflector. Such retro reflector makes it possible to increase the intensity of the light coupled through the optical gate, as a part of the back reflected light will be reflected towards and through the optical gate by the main reflector. In other words the retro reflector makes it possible to couple the outermost part of the light beams through the optical gate.

U.S. Pat. No. 1,256,522 discloses an illumination system where an electric lamp is provided with a socket, which is positioned within a tubular sleeve arrange axially of a reflector casing. The reflector is formed as an elliptic reflector. A hemispherical retro reflector is detachably secured to the main reflector. The retro reflector has an opening aligned with the lamp and wherein a tubular shell is into which a lens casing is telescopically fitter for adjustment toward or away from the lamp. The lens casing comprises a number of lenses. Further an annular cooling chamber has been arranged around the tubular shell. The annular cooling chamber comprises an inlet tube connected to blowing means and cooling air is forced into the cooling chamber. A number of apertures have further been provided in the retro reflector and around the tubular shell and the cooling air it thus forced into the reflector chamber thought these apertures. At the bottom of the main reflector a number of corresponding apertures have been provided around the socked and the cooling air is thus exhausted out of the reflector chamber through theses apertures. The cooling air is thus capable of removing heat from the lamp part itself however the heated cooling air is blown towards the bottom part of the lamp and can as a consequence result in heating of the socket part of the lamp, which is not desired with discharge lamps. Another issue is the fact the lamp system of U.S. Pat. No. 1,256,522 are very expensive to manufacture as many parts need to be assembled and aligned correctly in order to work probably.

U.S. Pat. No. 7,018,076 discloses a high performance compound reflector and cooling system for use with a projection system having a lamp for emitting light, an ellipsoid reflector for capturing said light from a first focal point of the ellipsoid reflector and focusing said light at a second focal point coincident with an integrator rod, and a spherical reflector for retro-reflecting light through the first focal point for reflection by said ellipsoid reflector to said second focal point. The shape of the ellipsoid reflector according to the present invention allows the spherical element to have a larger diameter at the interface between the ellipsoid and sphere. This provides a location for an air deflector in a shape similar to the back of the ellipsoid for channeling air over and outside of the ellipsoid and then along the inside of the sphere. The design of the reflector and air deflector allow cooling requirements to be substantially reduced. This system requires that the top part of the light source are positioned in the aperture of the retro reflector in order to allow the cooling air to cool the top part of the light source, which in many situations not possible. Further the cooling air will become heated as is flows across the outer part of the main reflector and as a consequence the cooling air will only be able to remove a limited amount of heat from the top part of the light source and will in many in situations even be heated so much that it actually provides heat to the upper part of the light source instead of removing heat.

Moving head lighting fixtures are commonly known in the art of lighting and especially entertainment lighting. A moving head light fixture typically comprises a head having a number of light sources which creates a light beam and number of light effect means adapted to create various light effects. The head is rotatable connected to a yoke and the yoke is rotatable connected to a base and the result is that the head can rotate and direct the light beam in many directions.

The competition in the market has traditionally been based on the optical performance of the moving head such as light output, number of light effects, color mixing etc. The competition in the market has lately changed such that parameters such as quality, serviceability and price have become the most important factors. There is thus a need for a competitive moving head lighting fixture with regard to quality, serviceability and price.

DESCRIPTION OF THE INVENTION

The object of the present invention is to solve the above described limitations related to prior art. This is achieved by an illumination device and retro reflector as described in the independent claims. The dependent claims describe possible embodiments of the present invention. The advantages and benefits of the present invention are described in the detailed description of the invention.

DESCRIPTION OF THE DRAWING

FIGS. 3*a* and 3*b* illustrate a one piece retro reflector body used in the reflector and cooling system according of the present invention;

FIGS. 4*a* and 4*b* illustrate a one piece retro reflector body with heat filters used in the reflector and cooling system according of the present invention;

DETAILED DESCRIPTION OF THE INVENTION

The present invention is described in view of a moving head lighting fixture including a light source generating a light beam, however the person skilled in the art realizes that some aspects of the present invention can be used in any kind of illumination devices and that any kind of light source such as discharge lamps, OLEDs, LED, plasma sources, halogen sources, fluorescent light sources, etc. can be used.

Figure 1:
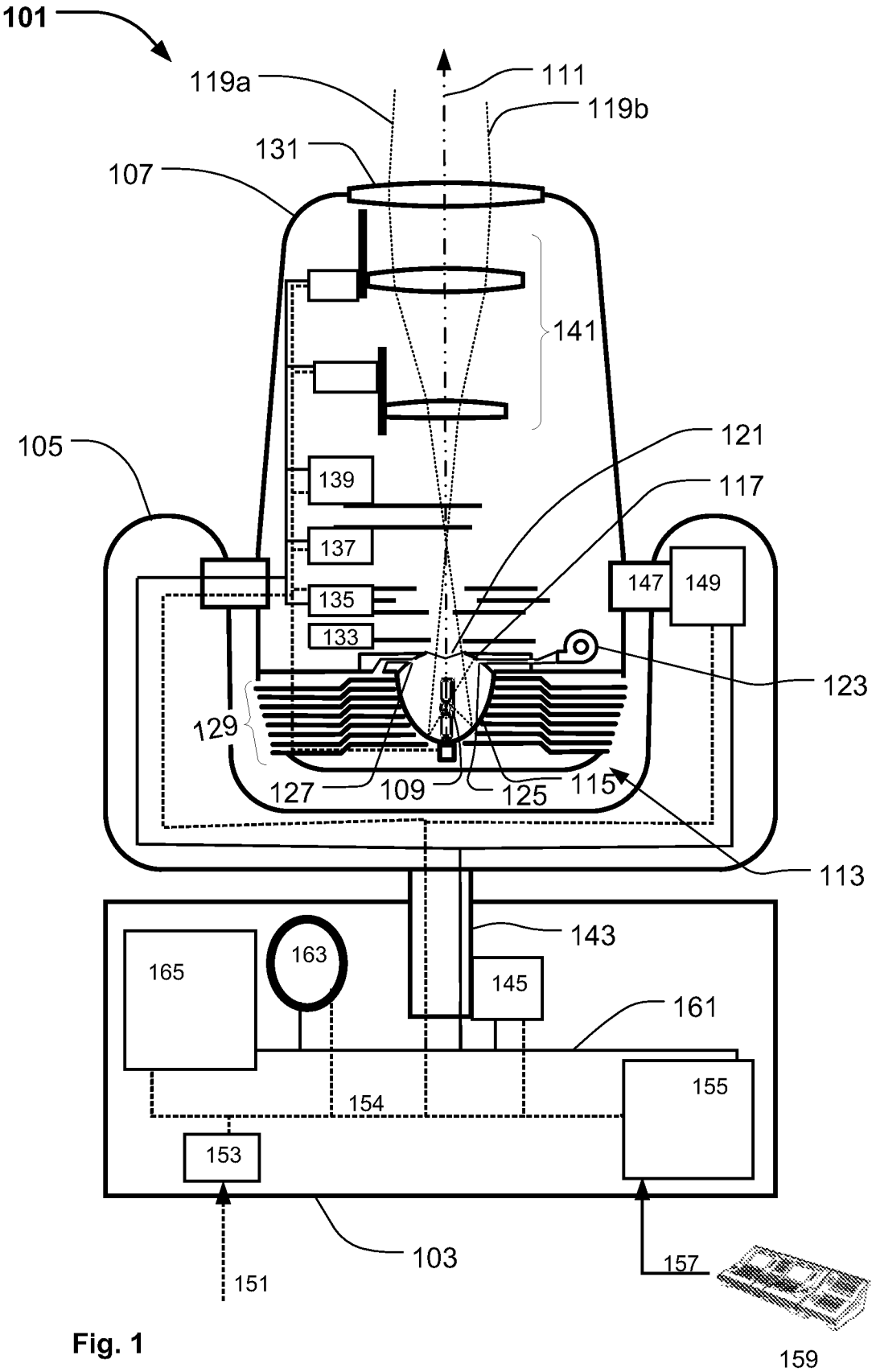
FIG. 1 illustrates an illumination device wherein a reflector and cooling system according the present invention have been integrated.

FIG. 1 is a structural diagram illustrating a moving head light fixture 101 comprising a reflector and cooling system according to the present invention. The moving head light fixture 101 comprises a base 103 rotatable connected to a yoke 105 and a head 107 rotatable carried in the yoke. The head comprises at least one light source 109 which generates a light beam propagating along an optical axis 111.

The light source 109 is arranged in a lamp reflector and cooling system 113 comprising a main reflector 115 wherein the light source 109 is arranged and a retro reflector 117 arranged outside off and facing the main reflector. The retro reflector 117 has an exit aperture 121 allowing a part of the light to pass along the optical axis 111. The main reflector 115 is adapted to reflect a part of the light generated by the light source along the optical axis 111 as illustrated by dotted line 119*a* showing a light ray which is reflected by the main reflector before it propagates along the optical axis and through the rest of the optical system, which will described below. It is noted the illustrated light rays only serve to illustrate the principles of the reflectors and do not illustrate exact and precise light beams. The person skilled in the art of optics will be able to design the shape of the main reflector such the light leaving the main reflector has a predetermined divergence, for instants in order to focus the light beams through an optical gate as described below.

The retro reflector 117 is adapted to reflect a part of the light generated by the light source back towards the main reflector and the main reflector 115 reflects the reflected light forwardly along the optical axis and through the exit aperture 121. Dotted line 119*b* shows a light ray which first is reflected by the retro reflector and then by the main reflector before it propagates along the optical axis and through the aperture 121. The concave retro reflector makes it possible to collect the outer part of light generated by the light source and which usually not will enter the later optical system.

The reflector and cooling system comprises also cooling means adapted to cool the light source, and the cooling means comprises a first blower 123 adapted to provide cooling air to the light source. The retro reflector comprises an air inlet 125 where through the first blower 123 blows cooling air towards the light source 109 and an air outlet 127 allowing the cooling air inside said reflector system to flow out. By providing the retro reflector with air inlet 125 and air outlet 127 makes it possible to provide very cold cooling air directly towards the light source as the first blower can blow the cooling air from another part of the lamp housing without the cooling air been preheated by other lamp and/or reflector parts before hitting the light source. At the same time the cooling air, which is heated by the light source can be removed from the top part of reflector system whereby it is avoided that the heated cooling air will heat the bottom part and/or socket part of the light source. Further by providing both the air inlet and air outlet at the retro reflector reduces light loss, as the main reflector can be maintained in its optimal form without inducing air inlet and/or air outlets for cooling air in the main reflector. Air inlets and/or outlets introduced in the main reflector results namely in a lager loss of light compared to similar air inlets and/or outlets in the retro reflector as both direct light form the light source and retro reflected light from the retro reflector is reflected by the main reflector and such inlets and/or outlets will thus result in the fact the less light is reflected along the optical axis. Typically the main reflector is a dichroic ceramic reflector at least partially surrounded by a number of cooling fins 129. The dichroic ceramic reflector is adapted to transmit infrared light and reflect visible light in order to remove heat form the light. The infrared light will transmit through the ceramic dichroic reflector and hit the cooling fins 129 where the infrared light are absorbed as heat, which can be dissipated to the surroundings through the cooling fins. Dichroic ceramic reflectors are fragile and may break when providing eventual inlets and/or outlets and by providing the air inlet and air outlet at the retro reflector makes it possible to avoid to introduce inlets and outlets at the dichroic main reflector. Further spacing, serving as air inlets, between the retro reflector and the main reflector can be avoided whereby more light will be reflected along the optical axis, as light loss through such spacing can be avoided.

The light is directed along the optical axis 111 by the reflector system and passes through a number of light effects before exiting the head through a front lens 131. The light effects can for instance be any light effects known in the art of intelligent lighting for instance a dimmer 133, a CMY color mixing system 135, color filters (not shown), gobos 137, animation effects 139, focus and zoom system 141, prism effects (not shown), framing effects (not shown), iris effects (not shown) or any other light effects known in the art.

The moving head light fixture comprises first rotating means for rotating the yoke in relation to the base, for instance by rotating a shaft 143 connected to the yoke by using a motor 145 positioned in the base or yoke (shown in base).

The moving head light fixture comprises also second rotating means for rotating the head in relation to the yoke, for instance by rotating a shaft 147 connected to the head by using a motor 149 positioned in the yoke or head (shown in yoke). The skilled person would realize that the rotation means can be constructed in many different ways using mechanical components such as motors, shafts, gears, cables, chains, transmission systems, bearings etc.

The moving head light fixture receives electrical power 151 from an external power supply (not shown). The electrical power is received by an internal power supply 153 which adapts and distributes electrical power through internal power lines 154 (dotted lines) to the subsystems of the moving head. The internal power system can be constructed in many different ways and the illustrated power lines is for simplicity illustrated as one system where all subsystems are connected to the same power line. The skilled person will however realize that some of the subsystems in the moving head need different kind of power and that a ground line also can be used. The light source will for instance in most applications need a different kind of power than step motors and driver circuits.

The light fixture comprises also a controller 155 which controls the other components (other subsystems) in the light fixture based on an input signal 157 indicative light effect parameters, position parameters and other parameters related to the moving head lighting fixture. The controller receives the input signal from a light controller 159 as known in the art of intelligent and entertainment lighting for instance by using a standard protocol like DMX, ArtNET, RDM etc. Typically the light effect parameter is indicative of at least one light effect parameter related to the different light effects in the light system. The central controller 155 is adapted to send commands and instructions to the different subsystems of the moving head through internal communication lines 161 (solid lines). The internal communication system can be based on a various type of communications networks/systems and the illustrated communication system is just one illustrating example.

The moving head can also comprise user input means enabling a user to interact directly with the moving head instead of using a light controller 159 to communicate with the moving head. The user input means 163 can for instance be bottoms, joysticks, touch pads, keyboard, mouse etc. The user input means can also be supported by a display 165 enabling the user to interact with the moving head through menu system shown on the display using the user input means 165. The display device and user input means can in one embodiment also be integrated as a touch screen.

Figure 2A:
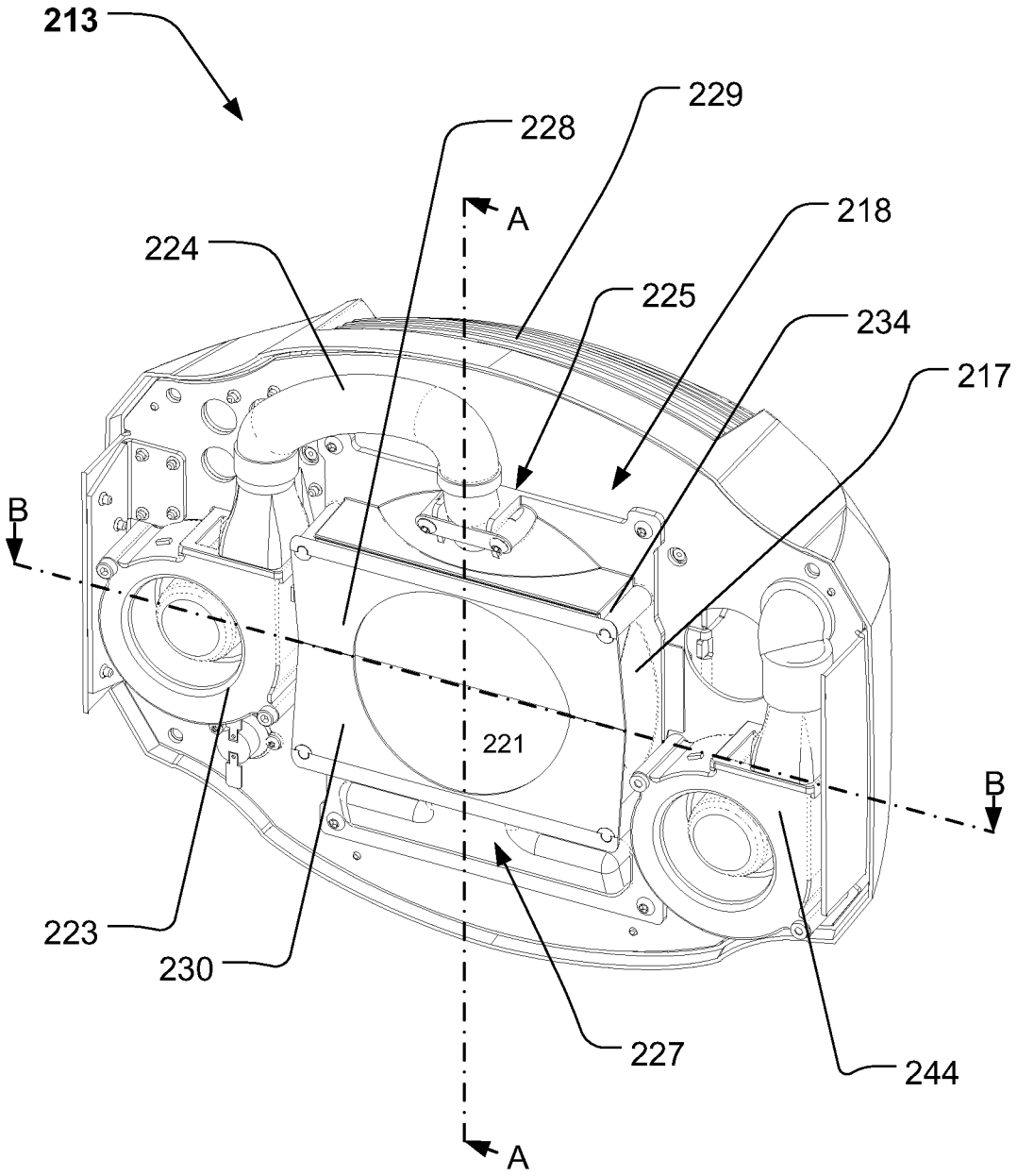
FIG. 2*a*-2*d* illustrate a reflector and cooling system according of the present invention.
Figure 2B:
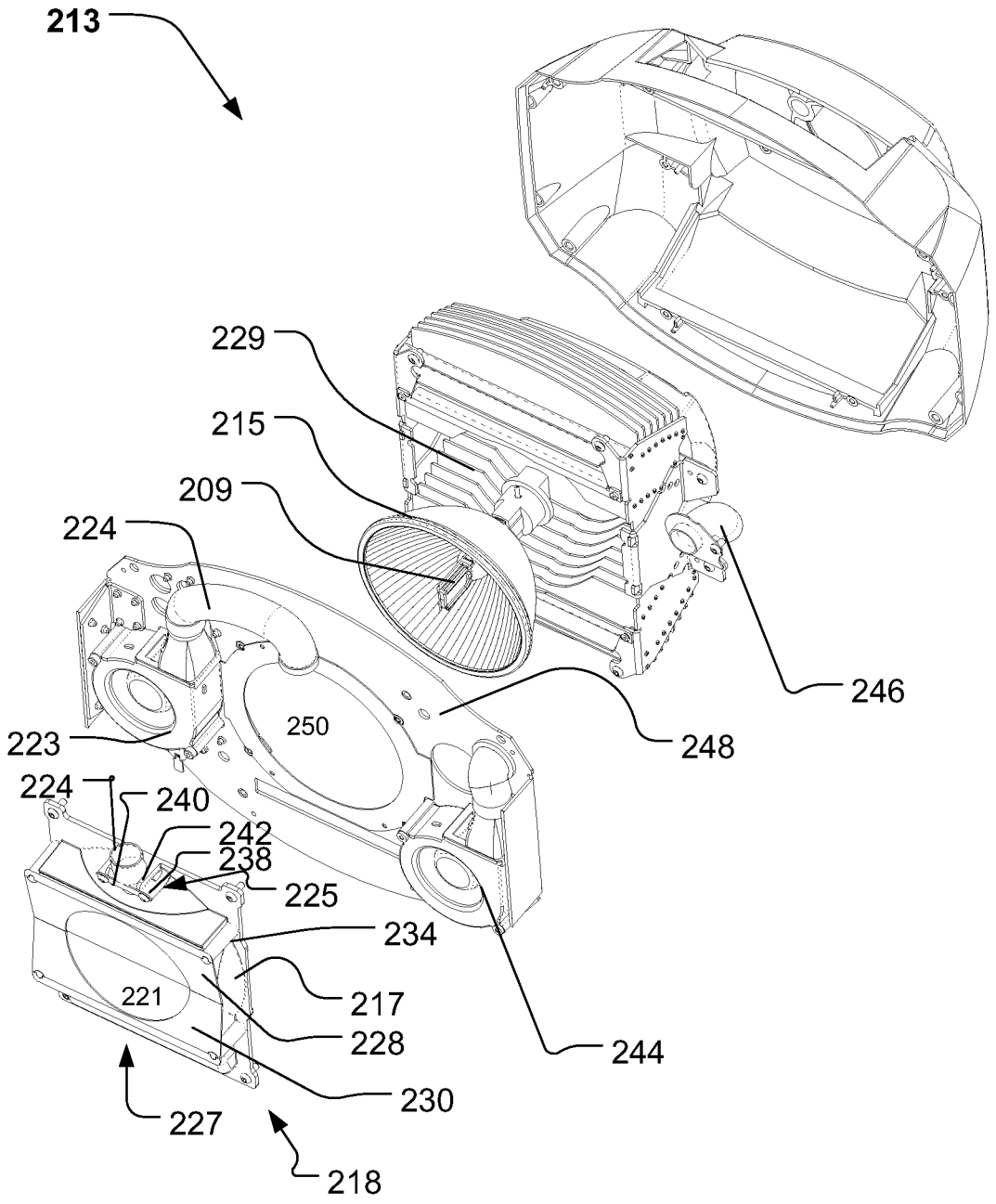
Figure 2C:
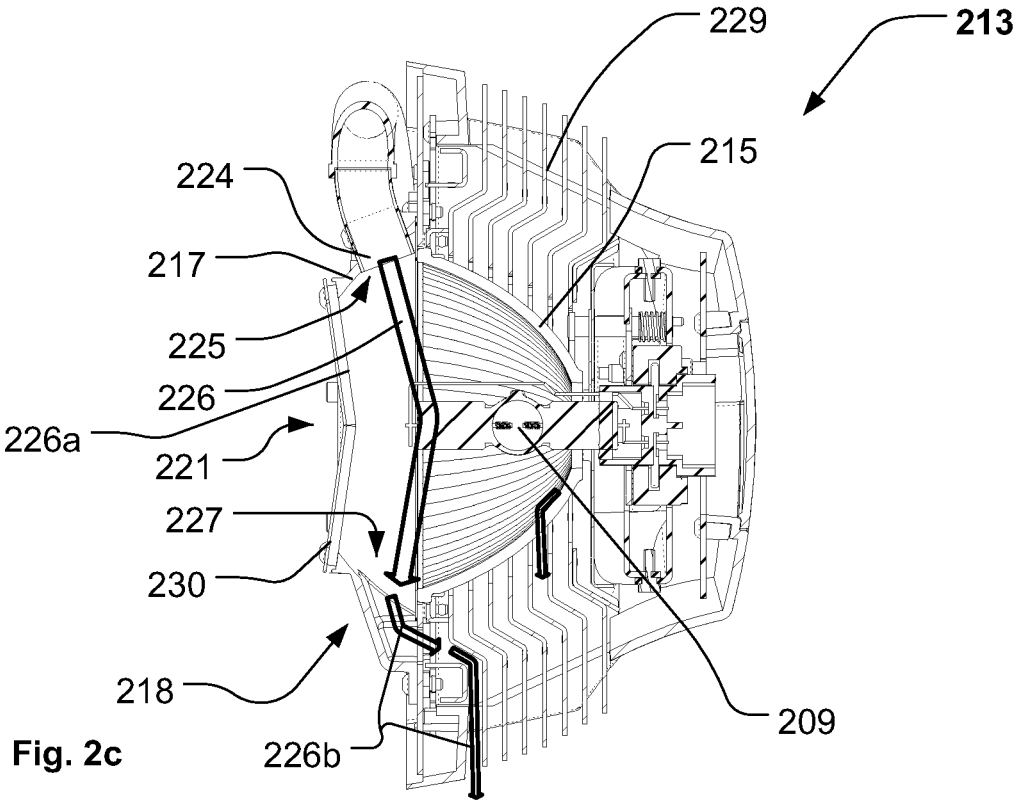
Figure 2D:
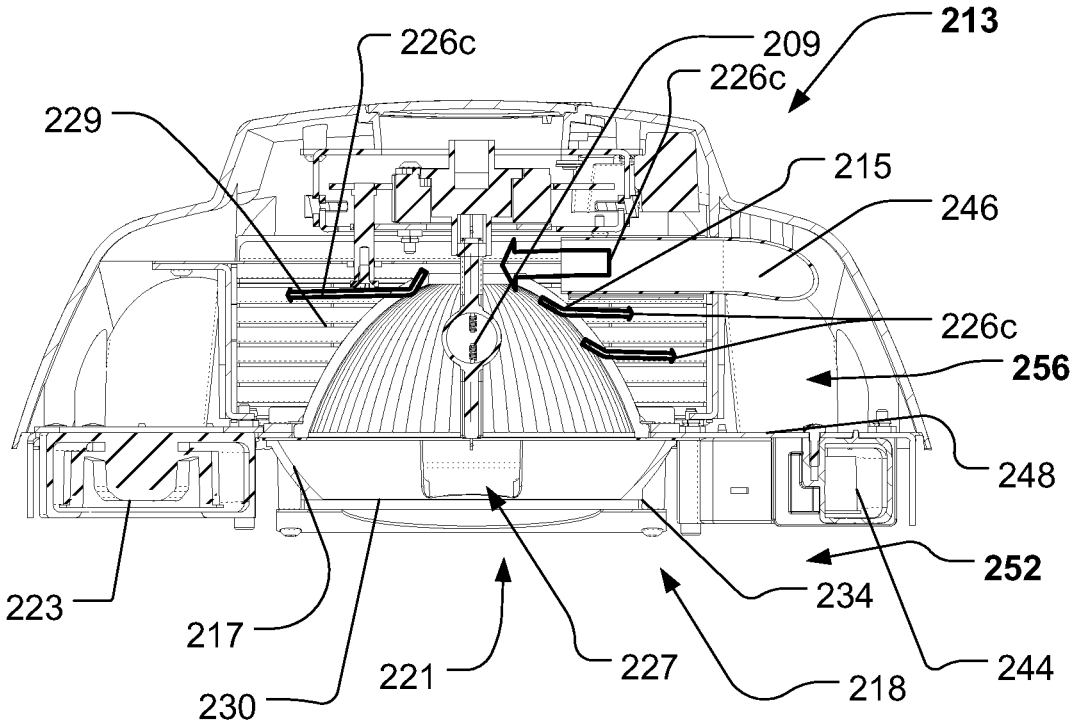

FIG. 2*a*-2*d* illustrate a reflector and cooling system 213 according to the present invention; where FIG. 2*a* is an perspective view from the light exiting side; FIG. 2*b* is an exploded perspective view from the light exiting side; FIG. 2*c* and FIG. 2*b* are cross sectional views respectively along lines A-A and B-B.

The light source 209 is arranged inside a main reflector 215 such that its central light emitting part is situated in the focal point of the main reflector and such that its bottom pinch is arrange in a socket situated outside the main reflector. In this embodiment the main reflector 215 is a ceramic dichroic reflector adapted to transmit infrared light to a number of cooling fins 229 at least partially surrounding the main reflector. Infra-red light emitted by the light sources it thus transmitted through the dichroic reflector and hits the cooling fins whereby the infra-red heat is dissipated to the surroundings through the cooling fins.

A retro reflector 217 is arranged outside and facing the main reflector. As described above and illustrated in FIG. 1, the retro reflector 217 is adapted to reflect a part of the light generated by the light source back towards the main reflector, which then reflects the light along the optical axis.

Further the retro reflector comprises an air inlet 225 and an air outlet 227 and a first blower 223 is adapted to blow cooling air through the air inlet 225 and towards the light source 209. In the illustrated embodiment the first blower 223 is adapted to blow the cooling air through a first duct 224 ending in the air inlet 225 of the retro reflector. The first duct is adapted to direct a part of the cooling air towards a top part of the light source 209 and the cooling air escapes the reflector cavity through the air outlet 127 as illustrated by air flow arrow 226 (In FIG. 2*c*). This makes it possible to make a very efficient cooling of the top pinch of the light source. Further the main reflector can be kept in one piece whereby reduction of light caused by cutaways in the main reflector is avoided.

In the illustrated embodiment the exit aperture 221 of the retro reflector 217 is formed as two intersecting planes delimited by the retro reflector and the two intersecting planes are angled (best seen in FIG. 2*c* and FIG. 3*a*-3*b*) in relation to the optical axis 211. By forming the exit aperture of the retro reflector as two intersecting planes angled in relation the optical axis make it possible to provide a first heat filter 228 on the first one of said intersecting planes and a second heat filter 230 on a second one of said intersecting planes. The first 228 and second heat 230 filters are embodied as dichroic filters adapted to transmit visible light and to reflect infrared light. Due to the angling in relation to the optical axis the first and second heat filters will reflect infrared light towards the main reflector and thus to the cooling fins, whereby infrared light is prevent from being reflected towards the light source, whereby extra heating of the light source is avoided.

In the illustrated embodiment the retro reflector is integrated into a one piece retro reflector body 218. This makes it possible to reduce the manufacturing cost of the illumination device as several parts can be integrated into one part, which is cheaper to manufacture rather then providing multiple numbers of parts. Further the manufacturing costs can be reduced as the integrated body can be mounted easily, with fewer faults and alignment of the retro reflector in relation the light source and main reflector can be accurate and simple.

The one piece reflector body 218 is illustrated in FIGS. 3 and 4; where FIGS. 3*b* and 4*a* are back perspective views respectively without and with heat filters 228, 230; and where FIGS. 3*a* and 4*b* are front perspective views respectively without and with heat filters 228, 230. The retro reflector 217 has been integrated as a central part of the one piece reflector body 218 with an outer part of the retro reflector body comprising securing means for securing the one piece reflector body to the main reflector and/or the cooling fins. In the illustrated embodiment the securing means have been provided as a number of holes 232 enabling the one piece reflector body to be secured using screws or the like. However other kinds of securing means like snap mechanisms, hooking mechanism or the like can also be used. Filter securing means 234 have also been integrated in the outer part of the one piece reflector body. The first and second heat filter can thus be secured to the one piece reflector body using the filter securing means. The filter securing means 234 have been embodied as a number of bosses protruding from a base part of the one piece reflector body and ending in the same level as the retro reflector. As a consequence the heat filters can be secured at the exit aperture of the retro reflector.

The air inlet 225 and air outlet 227 are also integrated as a part of the one piece reflector body and other additional components associated with the air inlet and air outlet can also be integrated into the one piece reflector body. In the illustrated emolument an outlet duct 236 have been integrated into the one piece reflector body and is in connection with the air outlet. The cooling air can be let away in a predefined direction as defined by the outlet duct and is in the illustrated embodiment adapted to guide the cooling air outside the lamp housing through and between two of the cooling fins 229 as illustrated by air flow arrows 226*a* (in FIG. 2*c*). Duct securing means have been integrated into the one piece reflector body. In the illustrated embodiment the input duct is secured to the one piece reflector body using duct securing means adapted to secure a duct to one piece reflector body. In the illustrated embodiment the duct securing means are embodied as pair of bosses 238 where between the duct is situated and a cross bar 240 is then arranged on top of the duct and the bosses 238 using screws. However other mechanical constructions can be provided. Further a pair of aligning flanges have also been 242 provided in connection with the bosses for enabling alignment of the inlet duct towards the light source.

The one piece retro reflector body can be molded using known molding techniques, which reduces the manufacturing costs. In one embodiment the one piece reflector body is molded using metal where the reflecting surface of the retro reflector is created by coating the reflecting surface parts with a highly reflective material as known in the art of the reflecting coatings. By providing the one pieces reflector body in metal provides a very robust retro reflector system and makes is also possible to dissipate heat through the one piece reflector body. However, it is noticed that the one piece reflector body also can be provided in polymer for instance in order to provide a lighter one piece reflector body.

Additionally the retro reflector makes it possible to provide a retro reflector with integrated cooling means to lamps reflector systems with no retro reflector and where additional cooling of the light sources is need when retro reflector is mounted. Further by providing the one piece retro reflector with air inlets and air outlets makes it possible adapt prior art reflector systems into a reflector and cooling system according to the present invention.

Returning to FIG. 2*a*-2*d*, the lamp reflector and cooling system comprises also second blowing means 244 adapted to blow cooling air towards the bottom part of the light source. The second blower 244 is adapted to blow the cooling air through a bottom air guiding duct 246 having an outlet pointing towards the bottom part of the light source. Cooling air it thus directed directly towards the socket part of the light source and there is an air gab between the cooling fins 229 and the main reflector 215 and the cooling air escapes the lamp housing between the cooling fins. In this way heat is also removed from the cooling fins. Air flow arrows 226*c* (in FIGS. 2*c* and 2*d*) illustrate the air flow created by the second blower.

The lamp reflector and cooling system comprises also a separation plate 248 having an aperture 250, wherein retro reflector and/or main reflector is arranged. The separation plate are adapted to divide the lamp housing wherein the lamp reflector and cooling system is arranged into a first housing compartment 252 and a second housing compartment 256. The outer housing of the first compartment is not illustrated, however it is to be understood that this compartment constitute volume at the bottom side of the separation plate illustrated in FIG. 2*d*. Similar the second housing compartment construes volume at the upper side of the separation plate illustrated in FIG. 2*d*. In the illustrated embodiment the main reflector is arranged in the second housing compartment and the retro reflector 217 is arranged in the first housing compartment.

The first blower is adapted to blow air from the first compartment into the retro reflector and thereafter out of the housing. The second blower is adapted to blow cooling air form the first compartment towards the bottom part the light source. As a consequence a high air pressure (compared to the air pressure of the first compartment of air) is created inside the reflector cavity defined by the retro reflector and the main reflector. Further a high air pressure is also created in the second compartment. Cooling air will thus flow form the first compartment to the reflector cavity and/or the second compartment and thereafter out of the housing. The first compartment is provided with vent holes allowing outside air to be sucked inside the first compartment. Efficient cooling of the lamp housing can hereby be provided and even in the many positions a moving head can have.

Figure 5A:
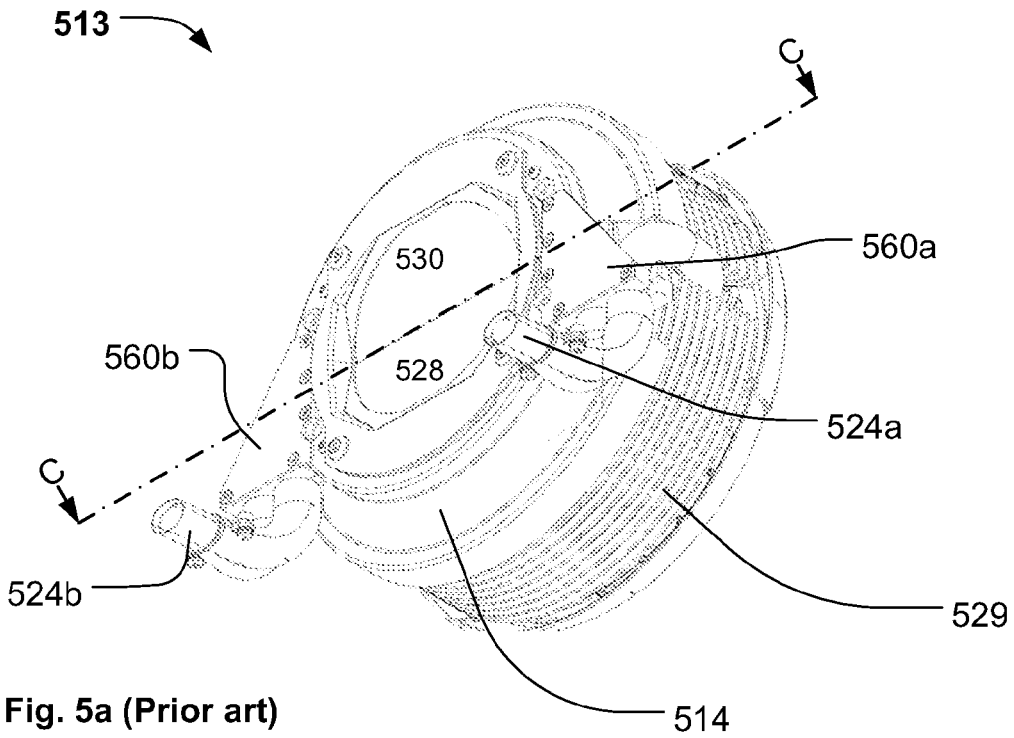
Fig. 5a (Prior art)
FIGS. 5*a*-5*b* illustrate a reflector and cooling system according to prior art.
Figure 5B:
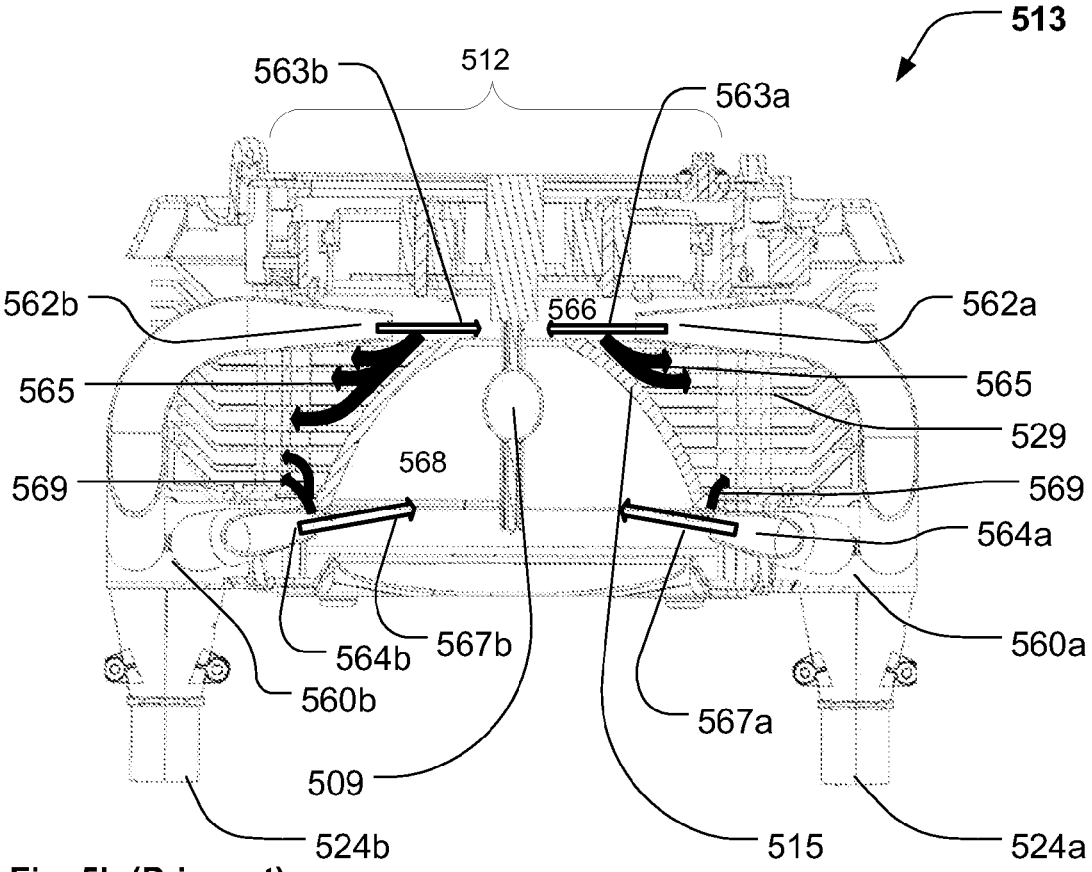
Fig. 5b (Prior art)

FIGS. 5*a* and 5*b* illustrate a reflector and cooling system according to the prior art. FIG. 5*a* illustrates a front perspective view (from the light emitting side) and FIG. 5*b* illustrates a cross sectional view (through line C-C) of a prior art reflector and cooling system 513. The reflector and cooling system corresponds to the one disclosed in EP 2133626 and U.S. Pat. No. 7,954,981 both incorporated herein by reference.

In brief the prior art reflector and cooling system 513 comprises a light source 509 is arranged inside a main reflector 515 such that its central light emitting part is situated in the focal point of the main reflector and such that its bottom pinch is arrange in a socket situated outside the main reflector. In this embodiment the socket is arranged in a lamp adjustment mechanism 512 similar the lamp adjustment means discloses in U.S. Pat. No. 789,533 and EP211243 both incorporated herein by reference. In this embodiment the main reflector 515 is a ceramic dichroic reflector adapted to transmit infra-red light to a number of discs shaped cooling fins 529 surrounding the main reflector. Infra-red light emitted by the light sources it thus transmitted through the dichroic reflector and hits the cooling fins whereby the infra-red heat is dissipated to the surroundings through the cooling fins. Further a first 528 and second 530 dichroic filters adapted to transmit visible light and to reflect infrared light are arranged outside the main reflector on a conical housing a housing 514, which has a conical side area.

A first duct 524*a* for cooling air is connected to a first manifold 560*a*. The first manifold divides the duct 524*a* into to a first lower air nozzle 562*a* and a first upper air nozzle 564*a*, which respectively are adapted direct air towards the bottom and top pinch of the light source. Similar a second duct 524*b* are connected to a second manifold 560*b*. The second manifold divides the second duct 524*b* into to a second lower air nozzle 562*b* and a second upper air nozzle 562*b*. The first and second upper air nozzles 564*a* and 564*b* are arranged at opposite sides of the light source and similar the first and second lower air nozzles 562*a* and 564*b* are arranged at opposite sides of the light source.

In operation, air generated from blowing means (not shown) is streaming through the ducts (524*a* and 524*b*) further through the manifolds (560*a*; 560*b*) and into the upper air nozzle (564*a*, 564*b*) and lower air nozzle (562*a*, 562*b*). The lower air nozzles 562*a* and 562*b*) provides two air streams (illustrated by arrows 563*a* and 564*b*) which are meeting and resulting in turbulent airflow in the cavity 566. The air which is flowing into the cavity 566 is leaving through opening between the dishes and the main reflector as illustrated by arrows 565. Similar the upper air nozzles (564*a* and 564*b*) provides two airstreams (illustrated by arrows 567*a* and 567*b*) which are meeting and resulting in turbulent airflow in the cavity 568 inside the main reflector. The air which is flowing into the cavity 568 is also leaving through the opening between the dishes and the main reflector as illustrated by arrows 569.

Figure 6A:
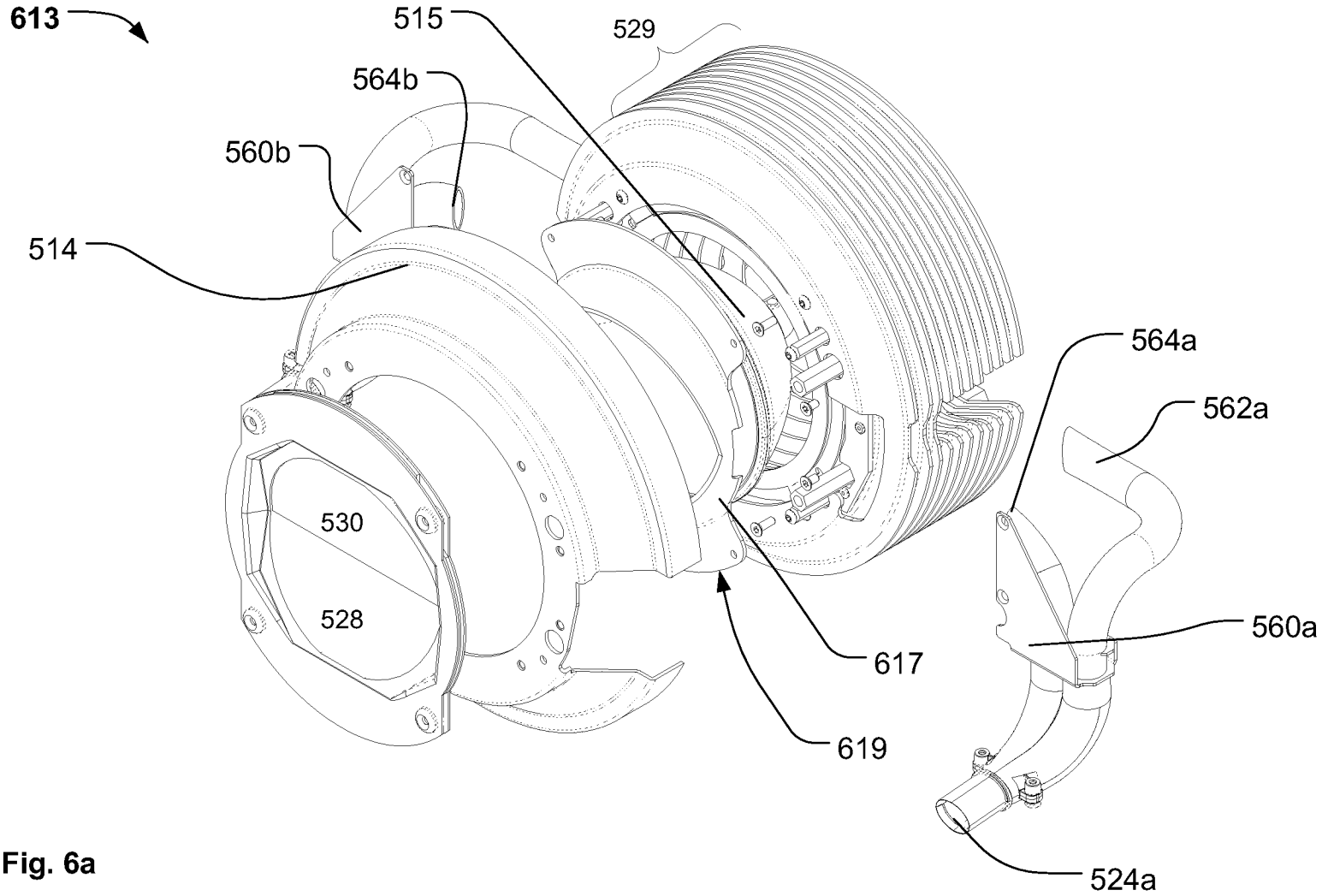
FIG. 6*a*-6*e* illustrate a reflector and cooling system according to prior art and which have be modified into a reflector and cooling system according to the present invention.
Figure 6B:
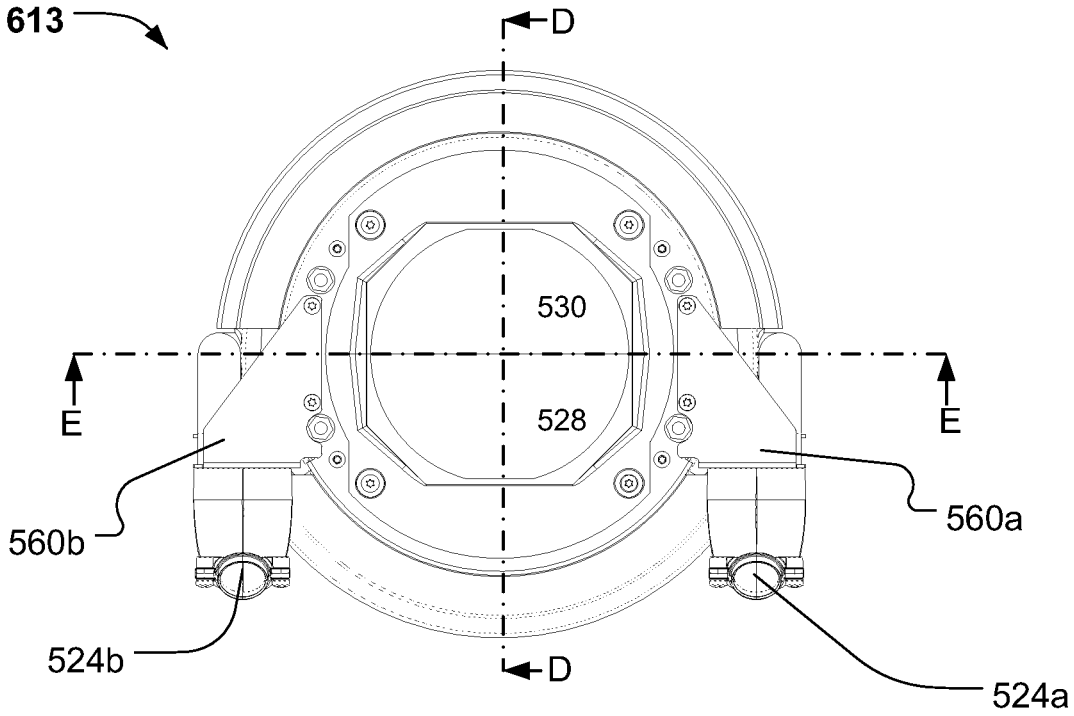
Figure 6C:
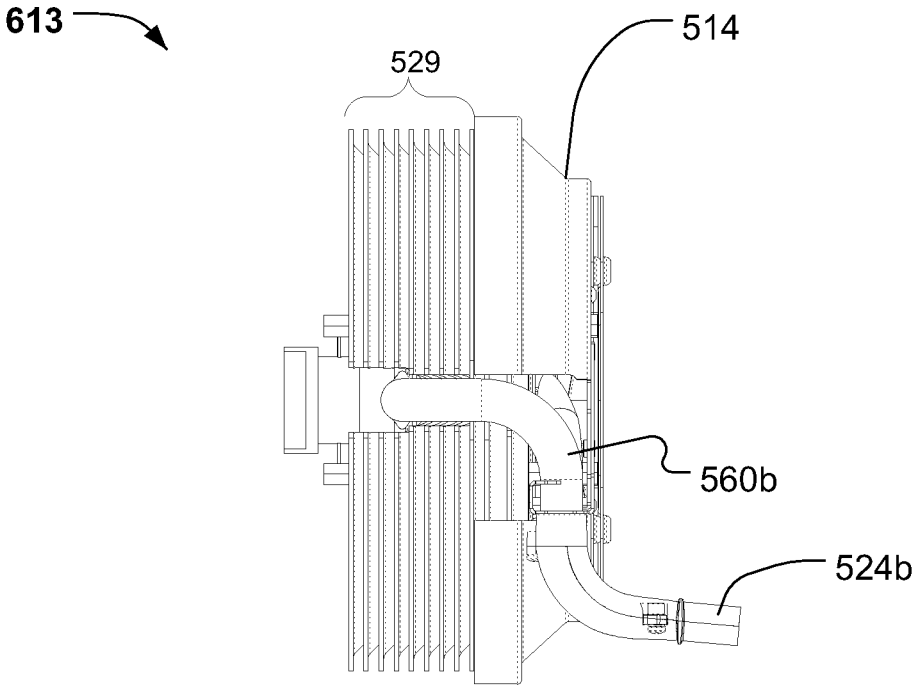
Figure 6D:
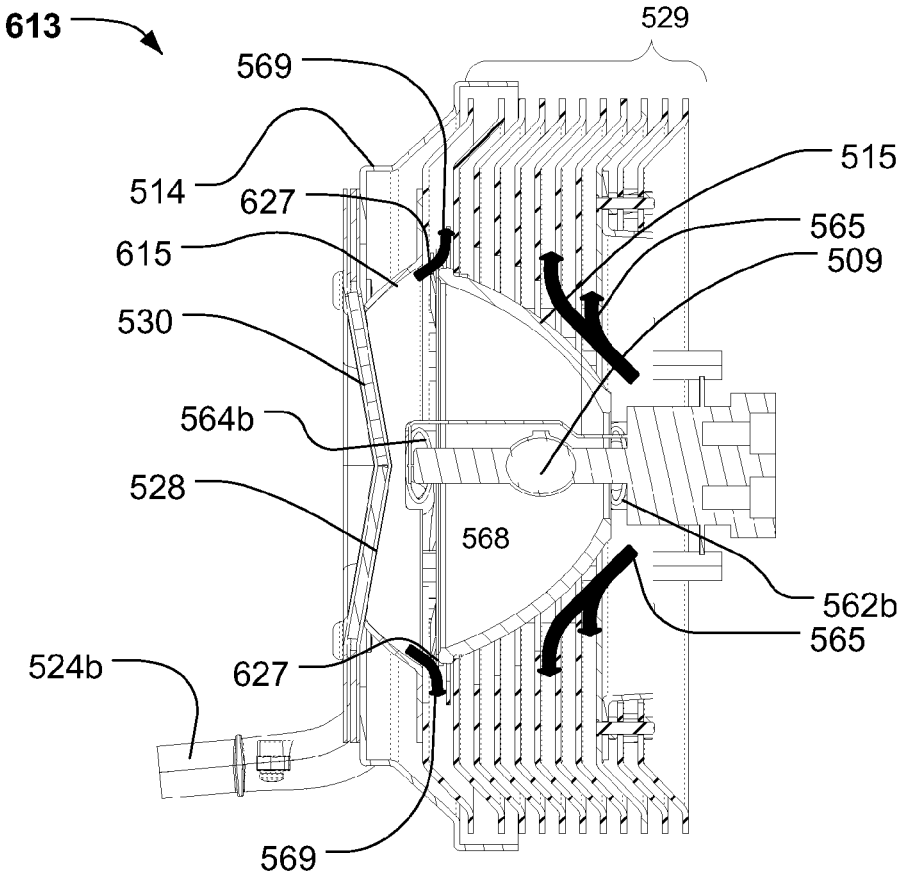
Figure 6E:
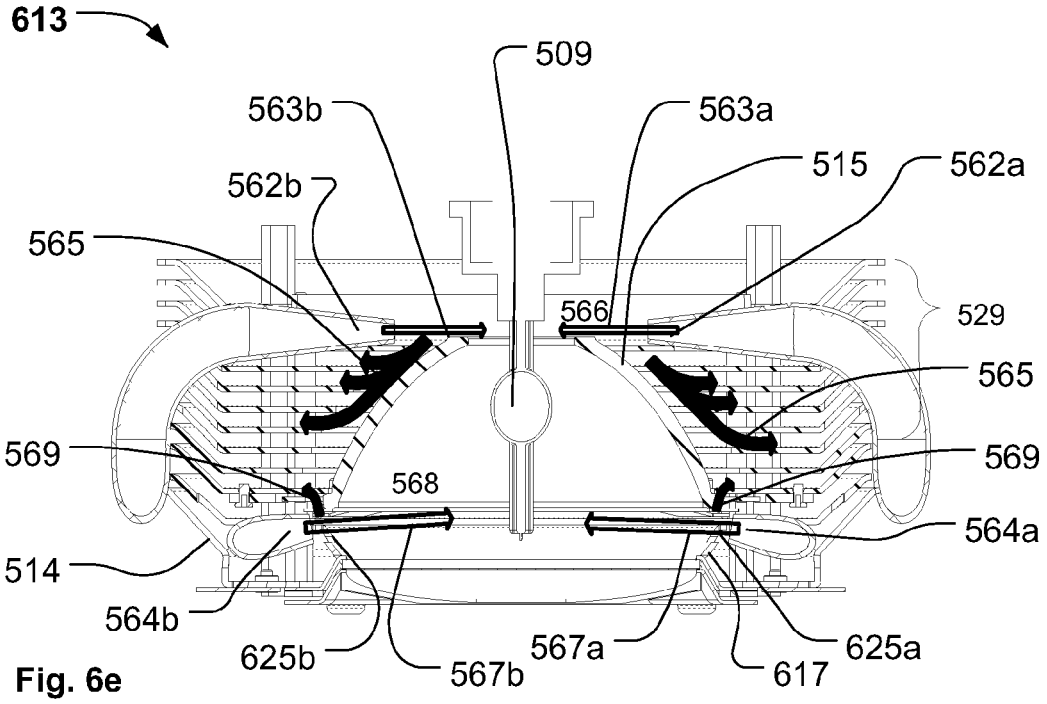

FIG. 6*a*-6*e* illustrates the reflector and cooling system of 5*a* and 5*b* where the reflector and cooling system has be updated to a cooling and reflector system according to the present invention. FIG. 6*a* is an exploded perspective view seen from the light emitting side; FIG. 6*b* is a front view, FIG. 6*c* is a side view, FIG. 6*d* is a cross sectional view through line D-D and FIG. 6*e* is a cross sectional view through line E-E. Only the differences between the prior art reflector and cooling system of FIGS. 5*a* and 5*b* will be described below and similar features in FIG. 6*a*-6*e* are labeled with the same reference numbers as in FIG. 5*a*-5*b*. The lamp adjustment mechanism 512 is not shown in FIG. 6*a*-6*e* and it is to be understood that the same lamp adjustment mechanism as in FIGS. 5*a* and 5*b* can be used but that is also is possible to provide other kind of lamp adjustment mechanisms.

The reflector and cooling system 513 in FIGS. 5*a* and 5*b* has be updated to a cooling and reflector system 613 according to the present invention by providing a retro reflector 617. The retro reflector 617 is embodied as a one piece molded body and arranged in the conical housing 514 where it is facing the main reflector 515. As described above and illustrated in FIG. 1, the retro reflector 617 reflects a part of the light generated by the light source 509 back towards the main reflector 515, which then reflects the light along the optical axis.

The retro reflector 617 has been integrated as a central part of the one piece reflector body 619 (illustrated in FIG. 7*a*-*d*). The retro reflector comprises a first air inlet 625*a*, second air inlet 625*b* and air outlet 627. The first air inlet 625*a* and second air inlet 625*b* are embodied as cutouts in the retro reflector surface and the first and second air inlet are positioned at opposite sides in relation the light source and provided such that they will be arranged adjacent the upper air nozzles (564*a* and 564*b*). The two air streams are thus allowed to blow towards the top part of the light source, as illustrated by flow arrows 567*a* and 567*b*. The air outlet is provided by letting the outer edge of the retro reflector be a little bit larger than the main reflector, which allows air the flow out of the cavity 568 along the edge of the retro reflector as illustrated by arrows 569. This does not cause in heating of other part of the light source as the heated cooling air escapes through the cooling fins, whereby heat is removed directly without being able to heat other parts of the light source. The introduced retro reflector will barely influence the flow of cooling air in the reflector and cooling system as the retro reflector allows upper air streams 567*a* and 567*b* to flow as before and allow the cooling air to escape through the air outlet 627. The retro reflector is provided inside the conical housing and will as a consequence not affect the outer dimensions of the reflector and cooling system 613.

Figure 7A:
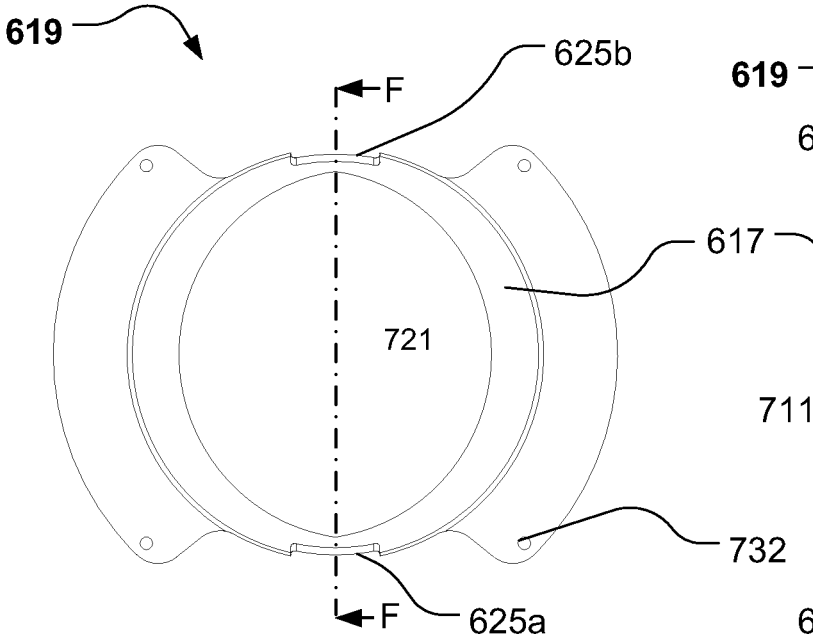
FIG. 7*a*-7*d* illustrate a one piece retro reflector body used in modify a prior art reflector and cooling system into a reflector and cooling system according of the present invention.
Figure 7B:
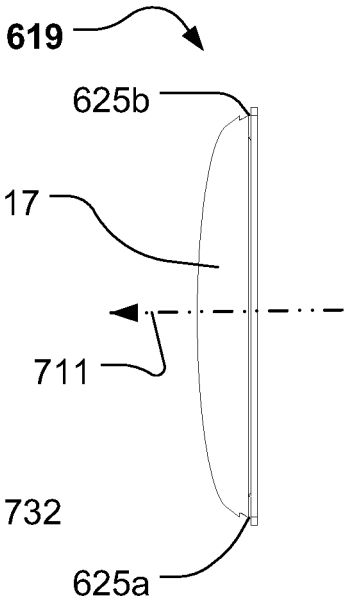
Figure 7C:
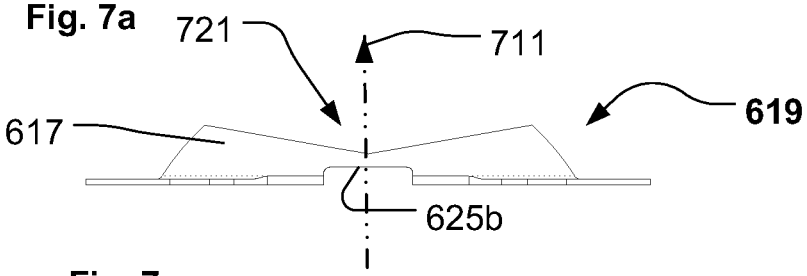
Figure 7D:
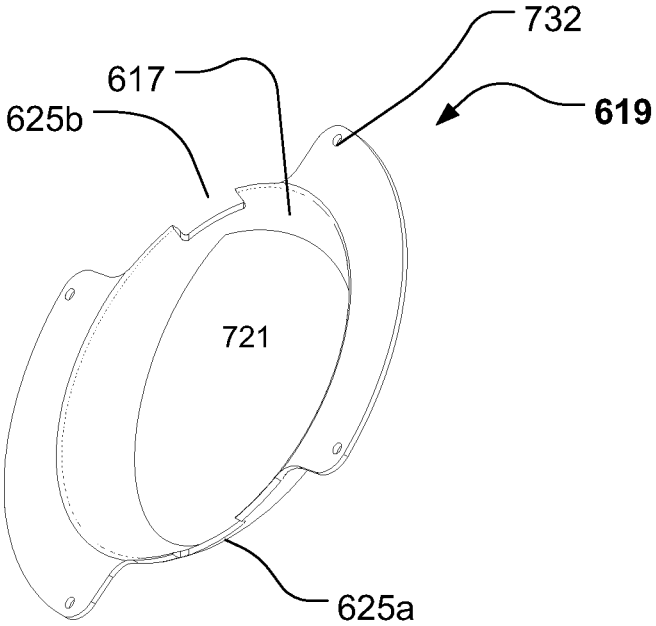

FIG. 7*a*-7*b* illustrated the retro reflector body 619 which has been integrated into the reflector and cooling system illustrated in FIG. 6*a*-6*e*. FIG. 7*a* is a bottom view (the side facing the main reflector 515); FIG. 7*b* is a cross sectional view through line F-F; FIG. 7*c* is a side view and FIG. 7*d* is a perspective view seen from the bottom side.

The retro reflector 617 has been integrated as a central part of the one piece reflector body 617 and the one piece reflector body comprises an outer part 734 comprising securing means for securing the one piece reflector body to the upper one of the disc shaped cooling discs 629. In the illustrated embodiment the securing means have been provided as a number of holes 732 enabling the one piece reflector body to be secured using screws or the like. However other kinds of securing means like snap mechanisms, hooking mechanism or the like can also be used.

In the illustrated embodiment the exit aperture 721 of the retro reflector 617 is formed as two intersecting planes delimited by the retro reflector surface 617 and the two intersecting planes are angled (best seen in FIG. 7*c* and FIG. 7*d*) in relation to the optical axis 711. By forming the exit aperture of the retro reflector 617 as two intersecting planes angled in relation the optical axis make it possible to arrange the retro reflector body inside the conical housing 714 and let the retro reflector be positioned just below the first heat filter 628 and a second heat filter 630. This makes it provide as larger retro reflector whereby more light can be recycled through the reflector system.

Figure 8:
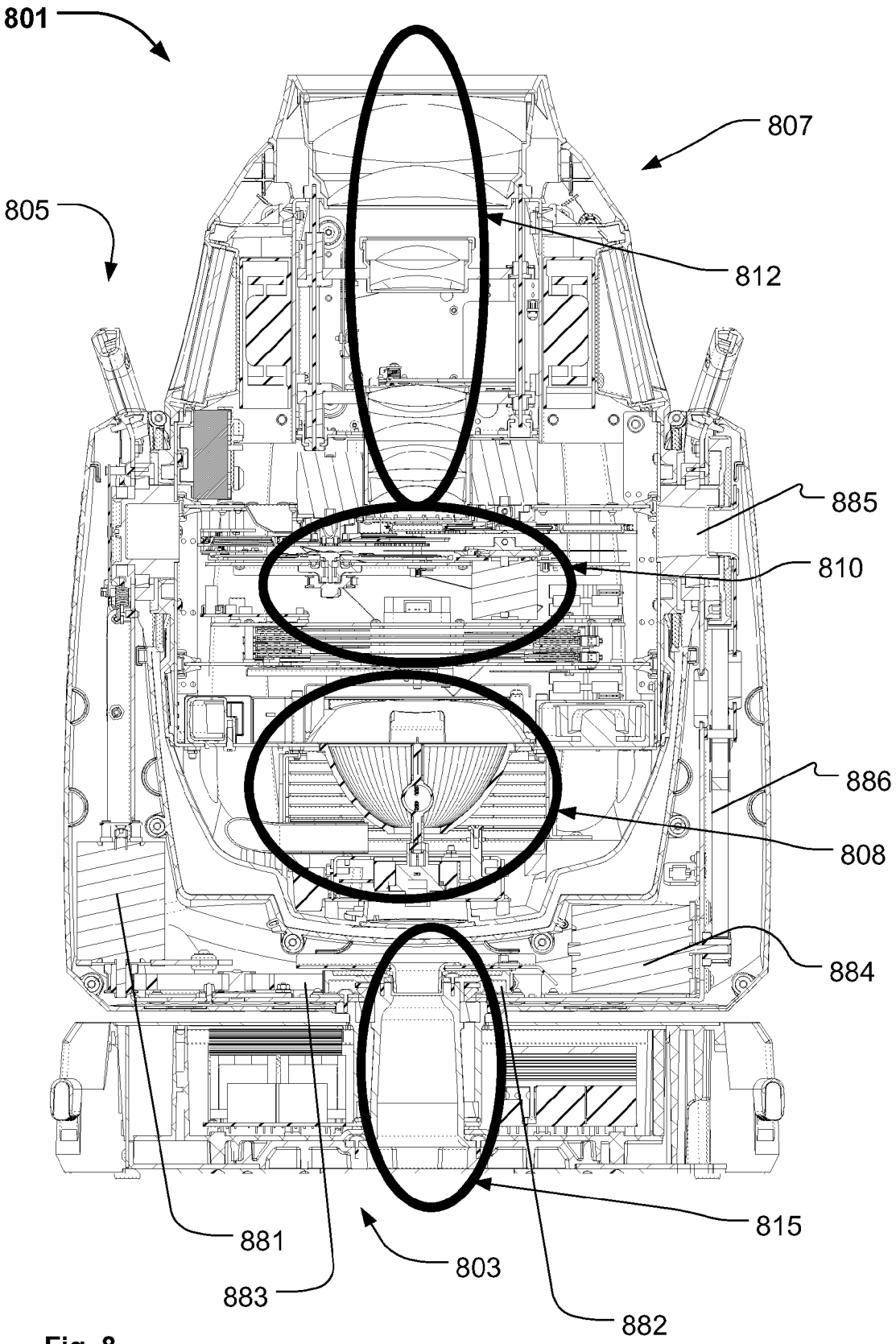
FIG. 8 illustrates a cross section of a moving head light fixture where reflector and cooling system according of the present invention has been integrated.

FIG. 8 is a cross sectional view of a moving head light fixture 801 comprising a base 803 rotatable connected to a yoke 805 and a head 807 rotatable carried in the yoke. The head comprises a reflecting and cooling system according to the present invention 8 reflector and cooling system according of the present invention) and as described above.

Circle 810 indicated a number of light effects for instance as described in connection with FIG. 1. Circle 812 indicate a zoom and focus system comprising a number of optical lenses, which can be implemented as known in the art. The base 803 has been embodied as described below in the patent application DK PA 2012 70060 filed by the applicant by the applicant $6^{th}$ of Feb. 2012. In this embodiment the first rotating means adapted to rotate the yoke 805 in relation the base 803 comprises a base-yoke connection (marked with circle 815) also embodied as described in the patent application DK PA 2012 70060 filed by the applicant by the applicant $6^{th}$ of Feb. 2012. A pan motor 881 is arranged in the yoke and adapted to drive a drive wheel 882 at the base-yoke connection through a drive belt 883, whereby the yoke rotates in relation to the base. Further the second rotating means for rotating the head in relation to the yoke, comprises a tilt motor 884 arranged in the yoke and adapted to rotate a shaft 885 through a drive belt 886 whereby the head rotates in relation to the yoke. The illustrated moving head light fixture 801 is just one example of an illumination device where the reflector and cooling system according to the present invention can be used and the person skilled in the art realizes that the reflector and cooling system can be implemented in any kind of illumination device.

The invention claimed is:

1. A lamp reflector and cooling system comprising:
- a light source arranged inside a main reflector, said main reflector reflecting a part of the light generated by said light source along an optical axis;
- a retro reflector arranged outside and facing said main reflector; said retro reflector having an exit aperture through which part of said light can pass; said retro reflector reflecting part of the light generated by said light source towards said main reflector, such that said main reflector then reflects the reflected light along said optical axis and through said exit aperture;
- a cooling apparatus to cool said light source, said cooling apparatus comprising a first blower;
- wherein said retro reflector comprises;
- an air inlet through which said first blower blows cooling air towards said light source; and
- an air outlet allowing said cooling air to flow out; and
- wherein said exit aperture is formed as two intersecting planes delimited by the retro reflector where the two intersecting planes are angled in relation to the optical axis.

2. The lamp reflector and cooling system according to claim 1 wherein said main reflector is a ceramic dichroic reflector.

3. The lamp reflector and cooling system according to claim 1 wherein at least a part of said main reflector is surrounded by a number of cooling fins.

4. The lamp reflector and cooling system according to claim 1 wherein said retro reflector is integrated into a one piece retro reflector body.

5. The lamp reflector and cooling system according to claim 1 wherein a first heat filter is arranged on a first one of said intersecting planes and a second heat filter is arranged on a second one of said intersecting planes.

6. The lamp reflector and cooling system according to claim 4 wherein said one piece retro reflector body comprises filter fasteners for securing a first heat filter and a second heat filter to said one piece retro reflector body.

7. The lamp reflector and cooling system according to claim 4 wherein said one piece retro reflector body is molded.

8. The lamp reflector and cooling system according to claim 1 wherein said cooling apparatus further comprises a second blower to blow cooling air towards a bottom part of said light source.

9. A lamp reflector and cooling system comprising:

a light source arranged inside a main reflector, said main reflector reflecting a part of the light generated by said light source along an optical axis;

a retro reflector arranged outside and facing said main reflector; said retro reflector having an exit aperture through which part of said light can pass; said retro reflector reflecting part of the light generated by said light source towards said main reflector, such that said main reflector then reflects the reflected light along said optical axis and through said exit aperture;

a cooling apparatus to cool said light source, said cooling apparatus comprising a first blower; and a separation plate having an aperture, wherein said retro reflector and/or said main reflector is arranged therein, said separation plate dividing a housing wherein said lamp reflector and cooling system is arranged into a first housing compartment and a second housing compartment;

wherein said retro reflector comprises;

an air inlet through which said first blower blows cooling air towards said light source; and an air outlet allowing said cooling air to flow out.

10. The lamp reflector and cooling system according to claim 9 wherein said main reflector is arranged in said second housing compartment and said retro reflector is arranged in said first compartment.

11. The lamp reflector and cooling system according to claim 9 wherein said first blower is adapted to blow air from said first compartment into said retro reflector and thereafter out of said housing.

12. The lamp reflector and cooling system according to claim 9 wherein said second blower is adapted to blow cooling air from said first compartment towards a bottom part of said light source, where after said cooling air leaves said housing through a number of openings between said cooling fins.

13. A retro reflector adapted to be arranged outside and facing a main reflector, where a light source is arranged inside said main reflector; said retro reflector having an exit aperture through which part of the light generated by said light source can pass; said retro reflector being adapted to reflect a part of the light generated by said light source towards said main reflector, such that said main reflector then reflects the reflected light through said exit aperture wherein said retro reflector comprises:

an air inlet through which cooling air can be directed towards said light source; and an air outlet allowing said cooling air to flow out; and wherein said exit aperture is formed as two intersecting planes delimited by the retro reflector where the two intersecting planes are angled in relation to the optical axis.

14. The retro reflector according to claim 13 wherein said retro reflector is integrated as a central part of a one piece retro reflector body and said one piece retro body comprises an outer part at least partially surrounding said retro reflector.

15. The retro reflector according to claim 14 wherein said outer part comprises a securing apparatus that arranges said one piece reflector body adjacent said main reflector.

16. The retro reflector according to claim 14 wherein said one piece reflector body is molded.

17. The retro reflector according to claim 14 wherein said retro reflector of said one piece retro reflector body is coated with reflective coating.

18. The retro reflector according to claim 13 wherein a first heat filter is arranged on a first one of said intersecting planes and a second heat filter is arranged on a second one of said intersecting planes.

19. The retro reflector according to claim 18 wherein said one piece retro reflector body comprises filter fasteners for securing said first heat filter and said second heat filter to said one piece retro reflector body.

20. The lamp reflector and cooling system according to claim 9 wherein said main reflector is a ceramic dichroic reflector.

21. The lamp reflector and cooling system according to claim 9 wherein at least a part of said main reflector is surrounded by a number of cooling fins.

22. The lamp reflector and cooling system according to claim 9 wherein said exit aperture of said retro reflector is formed as two intersecting planes delimited by the retro reflector where the two intersecting planes are angled in relation to the optical axis and in that a first heat filter is arranged on a first one of said intersecting planes and a second heat filter is arranged on a second one of said intersecting planes.

23. The lamp reflector and cooling system according to claim 9 wherein said cooling apparatus further comprises a second blower to blow cooling air towards a bottom part of said light source.

24. The lamp reflector and cooling system according to claim 9 wherein said retro reflector is integrated into a one piece retro reflector body.

25. The lamp reflector and cooling system according to claim 24 wherein said one piece retro reflector body comprises filter fasteners for securing a first heat filter and a second heat filter to said one piece retro reflector body.

26. The lamp reflector and cooling system according to claim 24 wherein said one piece retro reflector body is molded.

* * * * *